United States Patent [19]

Strasser et al.

[11] 4,360,862

[45] Nov. 23, 1982

[54] NAUTICAL LIGHT

[75] Inventors: Frederick G. Strasser, New Britain; Elwood R. Horwinski, Cheshire, both of Conn.

[73] Assignee: Gulf & Western Manufacturing Company, Southfield, Mich.

[21] Appl. No.: 215,880

[22] Filed: Dec. 12, 1980

[51] Int. Cl.[3] ..... F21V 1/00

[52] U.S. Cl. ..... 362/240; 362/80; 362/311; 362/362; 362/368; 362/375

[58] Field of Search ..... 362/240, 80, 311, 362, 362/368, 375

[56] References Cited

U.S. PATENT DOCUMENTS

| | | | |
|---|---|---|---|
| 3,072,784 | 1/1963 | Mann | 362/223 |
| 3,253,136 | 5/1966 | Faul | 362/363 |
| 3,963,915 | 6/1976 | Spivey | 362/363 |
| 4,135,228 | 1/1979 | Lones | 362/223 |

*Primary Examiner*—Stephen J. Lechert, Jr.
*Attorney, Agent, or Firm*—Meyer, Tilberry & Body

[57] ABSTRACT

A nautical light for watercraft includes a cylindrical metal housing having opposite ends, one of which includes a collar for mounting the light on a tubular mast or pole. The housing includes a pair of vertically tiered light chambers each having a lamp bulb coaxial with the housing axis and a window opening radially thereinto through the housing. A cylindrical closed end lens is axially received over the housing with the closed end of the lens overlying an end wall of the housing opposite the mounting end. The lens member is sealed with respect to the housing, and the closed end of the lens member is fastened to the end wall of the housing to facilitate removal of the lens for access to the light chambers. The housing and mounting collar provide a path for heat transfer to the mast on which the light is mounted, thereby providing thermal protection for the lens.

21 Claims, 9 Drawing Figures

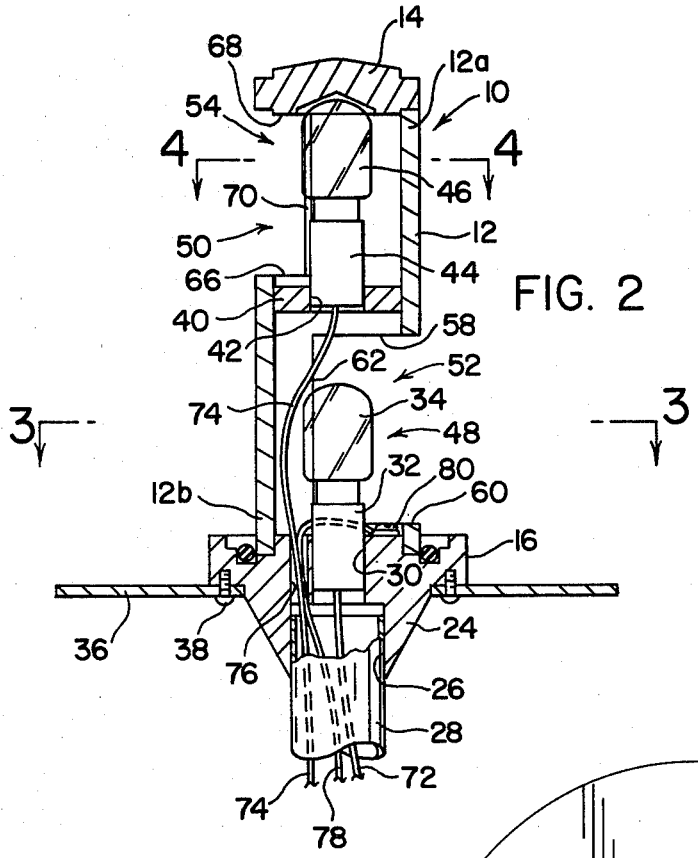
FIG. 2
FIG. 3
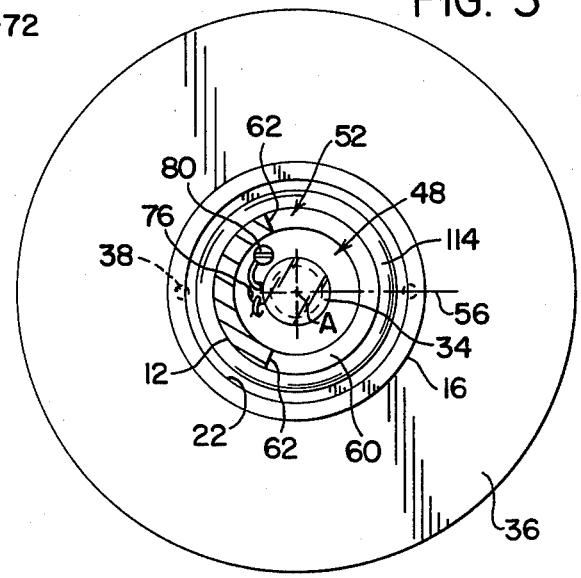
FIG. 4
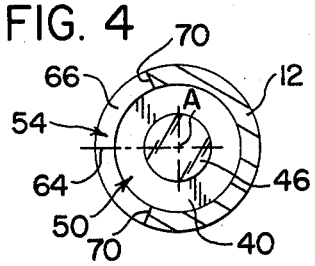

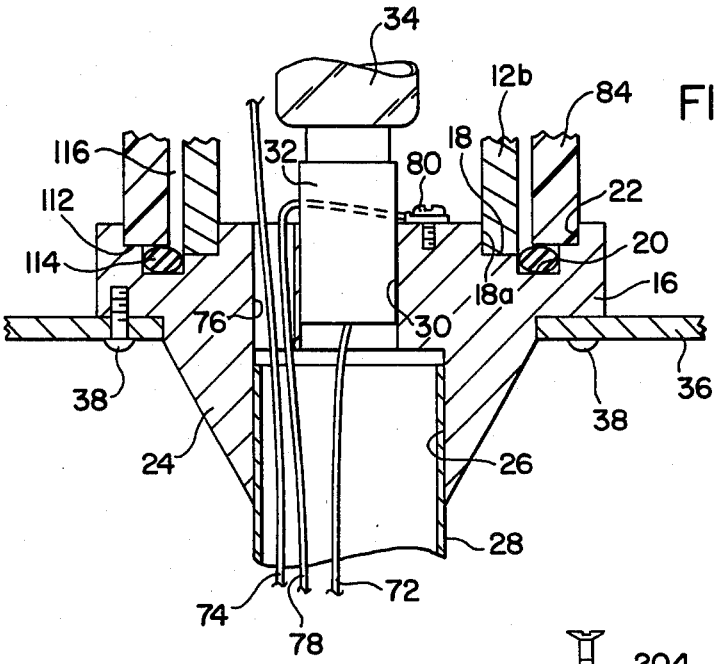
FIG. 8
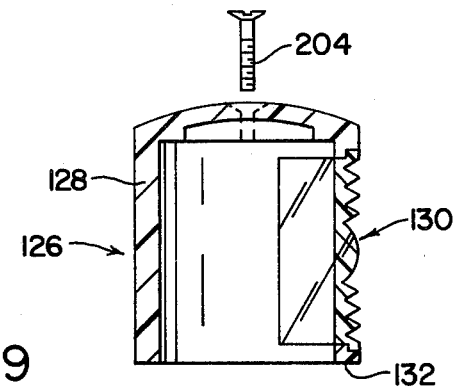
FIG. 9
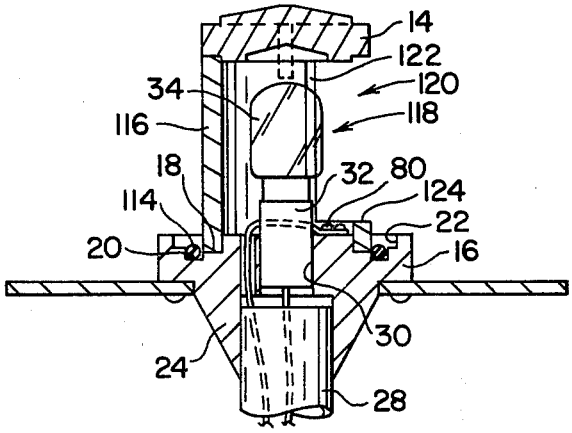

NAUTICAL LIGHT

BACKGROUND OF THE INVENTION

The present invention relates to the art of accessories for watercraft and, more particularly, to an improved nautical or running light for watercraft.

A wide variety of nautical or running light designs and structures have been provided heretofore for watercraft. While available lights for this purpose serve their intended function with regard to providing a light signal, there are a number of disadvantages and problems attendant to the manufacture and use thereof which affect cost, versatility, size and weight, durability and/or maintenance thereof. With regard to cost of manufacture, for example, the designs and structural configurations of previous running lights require complex and expensive dies for producing the component parts and, often, the structural complexity renders maintenance operations such as the replacement of a lamp bulb more time consuming and tedious than is desirable. With regard to versatility, varying the light signal angle or combinations of signal angles available to the consumer requires structurally different housing and lens components which, from the standpoint of cost of tooling therefor and inventory requirements, is uneconomical and impractical. Accordingly, selectivity with regard to a desired light signal angle, or combination of light signal angles, is undesirably limited.

From the standpoint of size, wieght and durability of nautical lights heretofore available, the lamp bulbs are generally enclosed in a sealed light chamber to minimize vapor corrosion of the lamp base and socket and, in an effort to minimize the size of the light unit, the lamp bulb is generally disposed very close to the lens component and the sealing component, and the latter is generally directly exposed to heat from the bulb. The light chamber structures do not provide for adequate disposition of heat from the lamp bulb, and such close proximity between the lamp bulb and lens often necessitates the use of glass for the lens component to avoid the deformation of a plastic lens which would result from heat build up. The use of a plastic lens generally results in a dimensionally larger light to achieve spacing to avoid heat distortion or degradation of the plastic. A glass lens is of course heavier than plastic, thus requiring a larger and/or heavier supporting component or housing therefore, whereby both size and weight are affected. Additionally, the close proximity between the lamp bulb and sealing component and/or direct exposure thereof to the heat of the lamp bulb, tends to structurally degrade the sealing component. This of course reduces the effective sealing of the light chamber, especially following removal of the lens for maintenance purposes such as changing a lamp bulb. From the standpoint of maintenance, the foregoing problem regarding heat build up, and the potential lens distortion and seal deterioration resulting therefrom, necessitates more frequent replacements of the seaing component and/or lens than is desirable. Further, vapor leakage necessitates the frequent cleaning of the lamp base and socket due to corrosion thereof.

SUMMARY OF THE INVENTION

In accordance with the present invention, an improved nautical light is provided by which the foregoing and other disadvantages of such lights heretofore provided are minimized or overcome. More particularly in this respect, a single or multiple lamp nautical light according to the present invention is comprised of a cylindrical tubular metal housing in which the lamp bulb or bulbs are mounted coaxial with the housing axis and in a corresponding light chamber. The housing has a window opening radially therethrough into each light chamber and a cylindrical lens surrounds the housing and spans the window or windows. The housing is utilized as a heat sink to promote transfer of heat to a mast or similar support on which the housing is mounted. Such heat transfer provides thermal protection for the lens, enabling the use of plastic therefor and, in connection with the coaxial disposition of the lamp bulb or bulbs in the housing, enables minimizing the the cross-sectional dimension of the light. Such minimizing of the cross-sectional dimensions and the use of plastic lens advantageously results in a decrease in the weight of the light assembly, thus reducing the stress on the mast or other support on which the light is mounted. The window opening into the light chamber has a given circumferential dimension corresponding to a desired light signal angle, and such window dimension can readily be varied from one light assembly to another without any major change in the manufacturing cost or procedure.

In accordance with another aspect of the present invention, a sealing arrangement is provided between the lens and metal housing in a manner which achieves the desired vapor tight seal with minimal heating of the sealing component. More particularly in this respect, the sealing ring is interposed between the lens component and metal housing exteriorly of the light chamber or chambers, thus avoiding direct exposure of the sealing component to heat from the lamp bulb or bulbs. Still further, the lens is mounted on the housing in a manner whereby disassembly for maintenance purposes is readily achieved by removal of threaded fasteners and removal of the lens from the housing.

The tubular metal housing advantageously enables axial tiering of lamp bulbs vertically in corresponding light chambers, each of which can have a window providing any desired circumferential dimension for the corresponding light angle. This advantageously enables providing total angular light signals up to 360° for the light assembly by various combinations of angles for the different light chambers. In either a single or multiple lamp nautical light according to the present invention, a portion of the tubular metal housing diametrically opposite the window for a light chamber serves both to reflect light from the bulb in the corresponding chamber and to provide a heat transfer path promoting heat transfer to the mast or other mounting component to provide the desired thermal protection for the lens component.

It is accordingly an outstanding object of the present invention to provide an improved nautical or running light for watercraft.

Another object is the provision of a light of the foregoing character structured to promote heat transfer to a support member on which the light is mounted.

Yet another object is the provision of a light of the foregoing character which optimizes the relative positioning between housing, lamp bulb and lens components with respect to thermal protection for the lens component.

A further object is the provision of a light of the foregoing character which is structurally simple and economical in connection with the production thereof.

Yet a further object is the provision of a light of the foregoing character in which the light chamber or chambers thereof are vapor tight through a sealing arrangement which promotes thermal protection for the sealing component.

Still a further object is the provision of a light of the foregoing character having improved durability with respect to distortion and/or deterioration of component parts through heat build up.

Yet another object is the provision of a light of the foregoing character which is of light weight construction, enables selectivity with respect to light signal angles, and the number of light signals, and in a manner which is economical from the standpoint of production cost and time and which is easy to install and to maintain following installation.

BRIEF DESCRIPTION OF THE DRAWINGS

The foregoing objects, and others, will in part be obvious and in part pointed out more fully hereinafter in connection with the following description of preferred embodiments of the invention illustrated in the accompanying drawings in which:

FIG. 2 is a sectional elevation view of the housing taken along line 2—2 in FIG. 1;

FIG. 3 is a cross-sectional view of the housing taken along line 3—3 in FIG. 2;

FIG. 4 is a cross-sectional view of the housing taken along line 4—4 in FIG. 2;

FIG. 8 is a sectional elevation view of the lower end of the light showing the lens sealing arrangement when the lens is mounted on the housing; and, FIG. 9 is an elevation view of a single lamp nautical light according to the present invention showing the lens member removed from the housing.

BRIEF DESCRIPTION OF PREFERRED EMBODIMENTS

Figure 1:
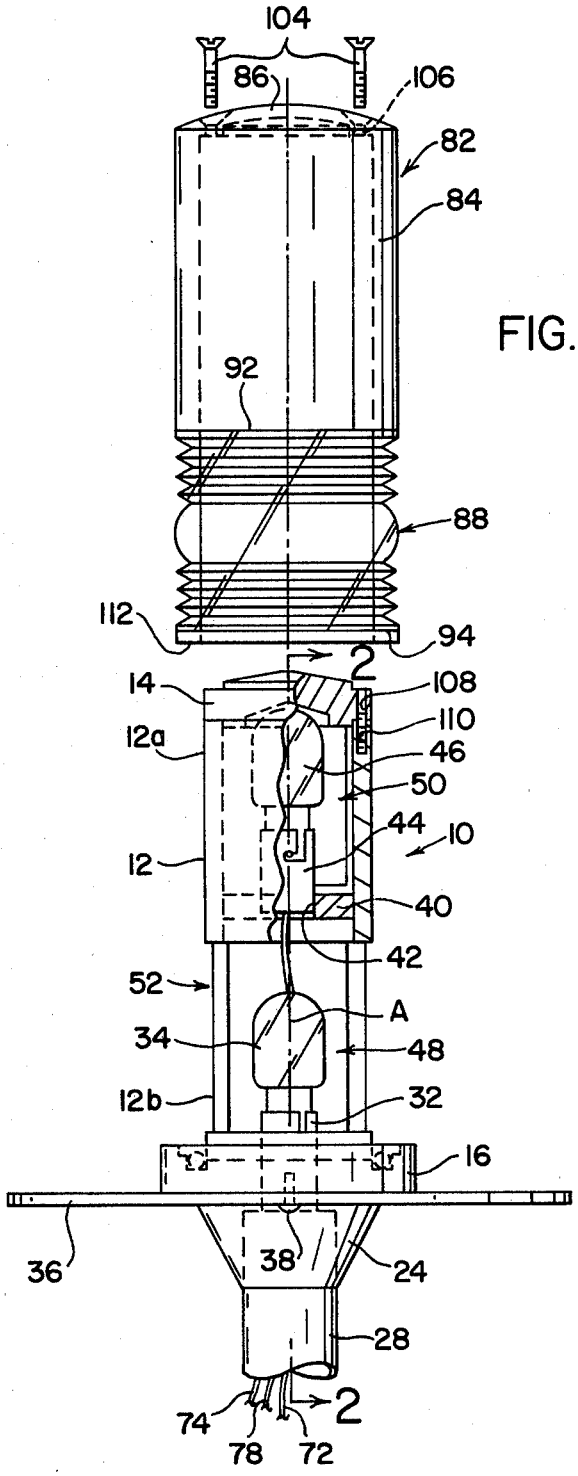
FIG. 1 is an elevation view of a vertically tiered nautical light according to the present invention showing the lens member removed from the housing.
Figure 5:
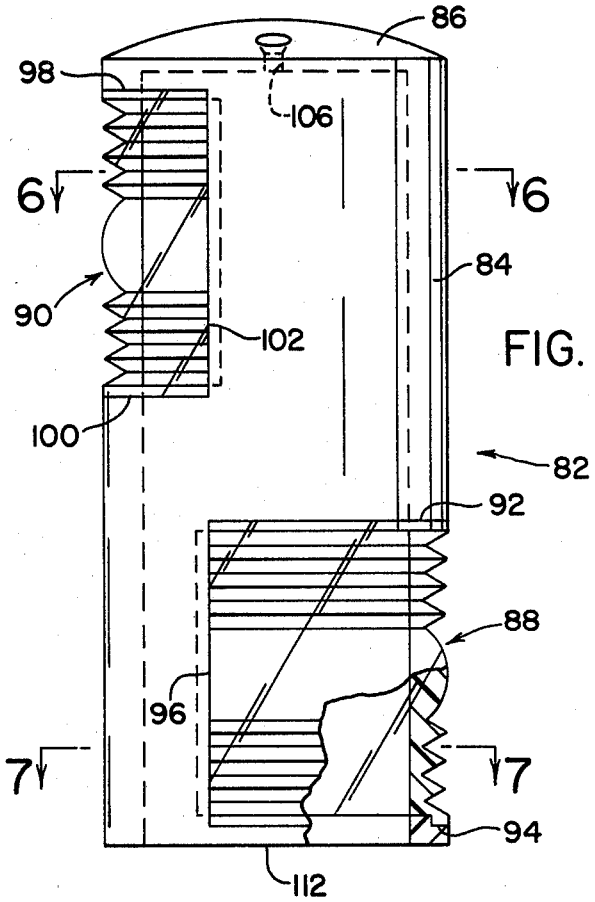
FIG. 5 is a side elevation view of the lens member looking in the direction from left to right in FIG. 1.
Figure 6:
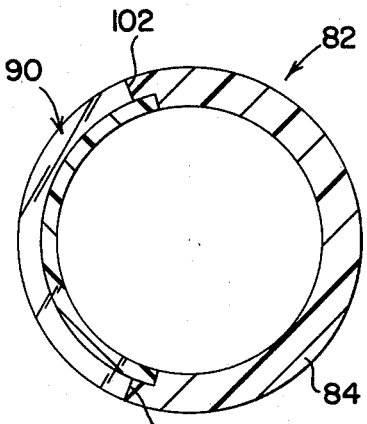
FIG. 6 is a cross-sectional elevation view of the lens taken along line 6—6 in FIG. 5.
Figure 7:
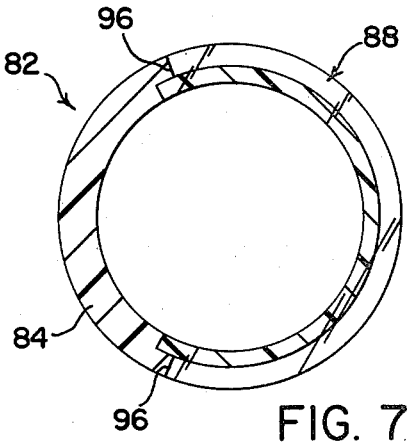
FIG. 7 is a cross-sectional view of the lens taken along line 7—7 in FIG. 5.

Referring now in greater detail to the drawings wherein the showings are for the purpose of illustrating preferred embodiments of the invention only, and not for the purpose of limiting the invention, a vertically tiered, dual lamp nautical light is illustrated in FIGS. 1–8 which includes a cylindrical tubular metal housing 10 having an axis A and comprising a body portion defined by a metal sleeve 12. Sleeve 12 has upper and lower ends 12*a* and 12*b*, respectively, and the housing further includes a metal end cap 14 on upper end 12*a* and a metal lamp socket supporting and mounting collar 16 on lower end 12*b*. As seen in FIG. 8, collar 16 is provided with an annular recess including a radially inner portion 18 receiving lower end 12*b* of sleeve 12 and having a radially inner wall 18*a* facially engaging the inner surface of lower end 12*b* of sleeve 12. Sleeve 12 and collar 16 are securely interengaged such as by a press fit or other mechanical connection between the sleeve and wall 18*a*, or by a suitable adhesive bond therebetween, such as by an epoxy adhesive. The recess in the upper side of collar 16 further includes an intermediate portion 20 and a radially outer portion 22 for the purpose set forth more fully hereinafter. The lower side of collar 16 includes a mounting sleeve portion 24, preferably integral therewith, and provided with a cylindrical bore 26 receiving the upper end of a tubular metal mounting member 28 by which the nautical light is suitably mounted on a watercraft. It will be appreciated that the mounting member could be an elongated mast, or a short tubular nipple which, in either case, would have its lower end, not illustrated, provided with a suitable mounting arrangement for attaching the light to a support surface on a boat. Collar 16 further includes a central opening 30 extending therethrough from the upper side and opening into bore 26, and a lamp bulb socket 32 is adhesively bonded or otherwise secured in opening 30 to support a corresponding lamp bulb 34 in a lower light chamber of the light assembly described hereinafter. Preferably, an annular shield plate 36 surrounds mounting sleeve 24 and is secured to the under side of sleeve 16 by means of threaded fasteners 38. Plate 36 provides a shield against downward light glare when the light is mounted in an overhead arrangement and, preferably, is of metal so as to serve in connection with heat transfer from the housing, as described hereinafter.

Sleeve 12 is provided intermediate its opposite ends with a lamp bulb socket mounting plug 40 secured within sleeve 12 such as by a press fit or other mechanical connection therebetween, or by a suitable adhesive bonding, such as by an epoxy adhesive. Mounting plug 40 is provided with a central opening 42 therethrough receiving a second lamp bulb socket 44. Socket 44 is adhesively or otherwise suitably secured in opening 42 and supports a corresponding lamp bulb 46 in an upper light chamber of the light assembly described hereinafter. Collar 16 and mounting plug 40 respectively provide first and second housing walls which, together with the portion of sleeve 12 therebetween, provide a first light chamber 48 in housing 10. End cap 14 provides a third housing wall, and end cap 14 and plug 40, together with the portion of sleeve 12 therebetween, provide a second light chamber 50 in the housing. Light bulb sockets 32 and 44, and thus light bulbs 34 and 46, are coaxial with axis A, and the sockets support the lamp bulbs axially centrally in the corresponding light chamber. While lamp bulb sockets 32 and 44 could be suitably mounted on collar 16 and plug 40 as opposed to being mounted within openings therein, the latter is preferred in that it enhances axial compactness of the light assembly and heat dissipation.

Sleeve 12 is cut to provide a window 52 for light chamber 48 and a window 54 for light chamber 50, each window providing a desired light signal angle for the corresponding light chamber. More particularly in this respect, as will be appreciated from FIGS. 2, 3 and 4, window 52 opens radially into light chamber 48 along an axis 56 and has circumferentially extending upper and lower edges 58 and 60, respectively, and circumferentially spaced apart axially extending side edges 62. Similarly, window 54 opens radially through sleeve 12 along an axis 64 and has a circumferentially extending lower edge 66 and a circumferentially extending upper edge 68 defined by the inner side of end cap 14, and further has circumferentially spaced apart axially extending side edges 70. Window axes 56 and 64 are circumferentially offset from one another and, in the embodiment illustrated, are circumferentially offset for windows 52 and 54 to be diametrically opposed with respect to axis A. It will be appreciated that the axially extending side edges of each of the windows can be circumferentially spaced apart with respect to one another to provide any desired light signal angle for the corresponding light chamber. Thus, as shown for example in the preferred embodiment, side edges 62 can be circumferentially spaced apart to provide a light angle with respect to axis A of 225° from light chamber 48, and side edges 70 can be spaced apart to provide a light angle of 135° from chamber 50, thus providing a total light angle of 360° for the two light chambers. While the upper edge of light chamber 50 is defined by the inner side of cap member 14 in the embodiment illustrated, it will be appreciated that the upper end of sleeve 12 could be circumferentially continuous in a manner similar to that of lower end 12*b* of the sleeve to provide the upper edge of the window 54.

Conductor and grounding wires for the lamps are brought into the housing through mounting member 28. More particularly in this respect, conductor wire 72 is connected to socket 32, conductor wire 74 extends through an opening 76 in mounting collar 16 and is connected to socket 44, and grounding wire 78 extends through opening 76 and is attached to the mounting collar by means of a screw 80.

The light assembly further includes a closed end cylindrical lens 82 axially received over housing 10 and secured thereto as set forth more fully hereinafter. Preferably, lens 82 is comprised of an opaque cylindrical plastic body portion 84 closed at its upper end by an integral end wall 86 and having clear plastic lens inserts 88 and 90 adhesively bonded to the body portion in windows provided therein. Body portion 84 and inserts 88 and 90 can be of any suitable plastic, such as an acrylic plastic. Preferably, body portion 84 is black, and inserts 88 and 90 are constructed to provide Fresnel lens type covers for the light chambers in body portion 10. As will be appreciated from FIGS. 5, 6 and 7 of the drawings, together with FIG. 1, inserts 88 and 90 are positioned for axial and circumferential alignment with light chamber windows 52 and 54, respectively. Further in this respect, insert 88 has circumferentially extending upper and lower edges 92 and 94 corresponding respectively to upper and lower edges 58 and 60 of window 52 in sleeve 12, and has circumferentially spaced apart axially extending side edges 96 corresponding to side edges 62 of window 52. Similarly, insert 90 has upper and lower edges 98 and 100 corresponding respectively to upper and lower edges 68 and 66 of window 54 in sleeve 12, and has circumferentially spaced apart axially extending side edges 102 corresponding to side edges 70 of window 54. The circumferential spacing of side edges 96 of insert 88 provides the desired light signal angle for light chamber 48 which, as mentioned hereinabove in connection with the preferred embodiment illustrated, is 225°. Similarly, the circumferential spacing between side edges 102 of lens insert 90 provides the desired light signal angle for light chamber 50, namely 135° in the embodiment illustrated herein. While the lens could be of one-piece construction, entirely of transparent material, the composite structure illustrated is preferred in that the opaque portions provided by the black plastic prevent any light disbursement through the body portion of the lens, thus assuring confinement of the light signals to the desired angles therefor.

As mentioned hereinabove, lens 82 is axially received on housing 10 of the light assembly and, preferably, the lens is mounted on the housing by a pair of threaded fasteners 104 extending through openings 106 in end wall 76 of the lens and thence through openings 108 therefor in end cap 14 and into threaded openings 110 in upper end 12*a* of the sleeve 12. It will be noted at this point that, in the preferred embodiment, fasteners 104 also serve to secure end cap 14 in place with respect to sleeve 12. While end cap 14 could be secured to sleeve 12 by separate threaded fasteners, or by other suitable mechanical connection or even adhesive bonding, it is preferred to provide for end cap 14 to be removable from sleeve 12 upon removal of the lens to facilitate access to light chamber 50 for removing the lamp bulb therefrom.

In accordance with another feature of the light assembly, as best seen in FIG. 8, body portion 84 of lens 82 has a lower end edge 112 received in portion 22 of the recess in mounting sleeve 16 and overlying recess portion 20. Recess portion 20 receives an annular sealing ring 114 of neoprene rubber, or the like, which is axially and radially compressed by lower end edge 112 to provide a vapor tight seal between the lens and housing, and in which the sealing element 114 is protected from direct exposure to heat from lamp bulb 34 in light chamber 48.

As mentioned hereinabove, housing 10 is metal and, in this respect, sleeve 12, end cap 14, mounting collar 16, socket mounting plug 40 and mounting member 28 are all metal parts, preferably produced from aluminum. It will be appreciated from the foregoing description of the structure of the housing that end cap 14, the arcuate portion of sleeve 12 providing light chamber 50, socket mounting plug 40 and the portion of sleeve 12 thereabout, the arcuate portion of sleeve 12 providing light chamber 48, end 12*b* of the sleeve, and mounting collar 16 provide axial continuity for heat transfer between end cap 14 and the mounting collar. Such continuity promotes heat transfer to mounting collar 16 and to mounting sleeve portion 24 thereof, both of which are exposed to ambient air for cooling, and thence to mounting member 28 which is likewise exposed. Additionally, as mentioned above, shield plate 36 is preferably metal and, by its facial engagement with the under side of collar 16, serves to provide a heat transfer path exposed to ambient air, thus to supplement the desired transfer of heat away from the housing. Preferably, heat built up in the light chambers is minimized and such heat transfer is enhanced by providing for end cap 14, socket mounting plug 40 and mounting collar 16 to be relatively thick axially, and by providing for sleeve 12 to have a wall thickness which provides for the housing assembly to have a heat sink effect with respect to the light chambers. Preferably, to further enhance thermal protection for lens 82, the inner surface thereof is slightly radially spaced from sleeve 12 as indicated by numeral 116 in FIG. 8.

As an example of the dimensions of the component parts by which the foregoing heat transfer characteristics are achieved, sleeve 12 has an outside diameter of about 1.312 inches and a wall thickness of about 0.141 inch, end cap 14 has an axial thickness of about 0.406 inch, lamp socket mounting plug 40 has an axial thickness of about 0.375 inch, and mounting collar 16 has an axial thickness of about 0.375 inch between the upper surface thereof and the upper end of mounting sleeve portion 24. Further, collar 16 has an outside diameter of about 2 inches, and sleeve portion 24 thereof has a diameter at its upper end of about 1.500 inches. Further, mounting member 28 has an outside diameter of about 0.750 inch and a wall thickness of about 0.035 inch, and sleeve 12 has an axial length of about 3.50 inches. Lens 82 has an inner diameter of about 1.344 inches.

It will be appreciated from the foregoing description of the vertically tiered light assembly and the following description of FIG. 9 of the drawing that the principles of the present invention are applicable to a nautical light having a single light chamber. Moreover, a considerable number of the component parts employed in constructing the tiered light described hereinabove can also be employed in constructing a single light assembly, whereby the like component parts are designated in FIG. 9 by numerals corresponding to those appearing in FIGS. 1–8. With the latter in mind, it will be seen from FIG. 9 that the only component parts of a single light assembly which are different from those of a vertically tiered light assembly are the sleeve member of the body portion of the housing and the lens member, and that the differences are primarily of a dimensional nature. Thus, sleeve 116 for the single light assembly illustrated in FIG. 9 is of the same diameter as sleeve 12 to provide for mounting interengagement of the lower end thereof with collar 16 and is of an axial length to provide a single light chamber between collar 16 and end cap 14 which is associated with the upper end of the sleeve in the manner described hereinabove with respect to ene cap 14 and sleeve 12 of the vertically tiered assembly. In the single light assembly illustrated, sleeve 116 is provided with a window 120 opening radially into light chamber 118. In this respect, sleeve 116 is cut to provide circumferentially spaced apart axially extending side edges 122 and a circumferentially extending lower edge 124, and the under side of end cap 14 provides a circumferentially extending upper edge for the window. While only one of the side edges 122 of the window is seen in FIG. 9, it will be appreciated that the two side edges are circumferentially spaced apart to provide a desired angle for the light signal from light chamber 118. The single light assembly includes a closed end cylindrical lens 126 structurally similar to lens 82 described hereinabove and, in this respect, including an opaque body portion 128 and a clear insert 130 of Fresnel lens construction which axially and circumferentially corresponds with the edges of window 120 of light chamber 118. As in the vertically tiered light assembly, lens 126 is removably mounted on the housing by means of a pair of threaded fasteners 204, only one of which is seen in FIG. 9, and which interengage the lens and end cap 14 with sleeve 116 in the manner described hereinabove with regard to the vertically tiered light assembly. Further, it will be appreciated that lens 126 has a lower end edge 132 received in recess portion 22 of collar 16 and interengaging with seal ring 114 in recess portion 20 to provide a vapor tight seal when the lens is in the mounted position thereof.

While it is preferred, as described herein with respect to both the single and multiple light assembles, to provide for the circumferential spacing of the axially extending side edges of the windows to correspond to the desired angle for the light signal from the corresponding light chamber, it will be appreciated that such circumferential spacing of the side edges of the windows would not be necessary where, as in the preferred embodiments, the lens construction provides control of the light angle through the opaque body portion of the lens. In other words, the side edges of the window or windows opening through the body portion could be circumferentially spaced apart an angular distance greater than that of the desired angle for the light signal from the corresponding light chamber. It is only necessary in accordance with the present invention that the body portion provide axial continuity for heat transfer between the axially opposite ends of the housing, and such a heat transfer path would be provided with the foregoing structural modification. At the same time, even with the control of the light signal angle being achieved with the lens construction as described herein, it is preferred to provide for the side edges of the window or windows through the body portion to be circumferentially spaced apart in accordance with the desired light angle for the corresponding light chamber in that such construction optimizes the surface area of metal behind the lamp bulb for reflecting light and the mass of metal available circumferentially and axially of the chamber for heat dissipation and transfer to minimize heat build up in the light chamber.

It will be appreciated from the foregoing descriptions of the single and tiered light assemblies that a metal tube of given diameter and indeterminate length can be stocked and readily cut to provide sleeves having the length required for either of the single or tiered light constructions, after which the sleeve is cut along the length thereof to provide the number of windows required for the light assembly to be constructed. In connection with the cutting of a window or windows in the sleeve, it will be appreciated that any desired light signal angle for a given light chamber is readily achieved simply by varying the location of the cut lines for the circumferentially opposite sides of the window. It will be further appreciated that the end cap, mounting collar, sealing ring, lamp sockets and bulbs, are common to both the single and tiered light assemblies. It will be appreciated too that the tubular mounting member can be a stocked tube of indeterminate length from which desired lengths would be cut in accordance with a given light installation. Accordingly, the construction of the single and tiered assemblies is not only structurally simple and economical, both from the standpoint of cost of component parts and from the standpoint of the assembly operation, but additionally simplifies and minimizes inventory requirements with respect to the component parts thereof.

Other embodiments of the present invention as well as modifications of the preferred embodiment herein illustrated and described will be obvious and suggested to those skilled in the art upon reading the foregoing description. Accordingly, it is to be distinctly understood that the foregoing descriptive matter is to be interpreted merely as illustrative of the present invention and not as a limitation.

We claim:

1. A nautical light comprising housing means including a cylindrical tubular metal body portion having an axis and axially opposite ends, mounting means for said housing means at one of said opposite ends thereof, said housing means further including transversely extending metal wall means axially spaced apart from one another and interconnected with said tubular metal body portion, said tubular metal body portion and wall means together providing cylindrical light chamber means in said housing, means supporting lamp bulb means in said light chamber means coaxial with said axis, said tubular metal body portion having window means opening radially therethrough into said light chamber means, said window means including circumferentially spaced apart side edges, cylindrical lens means surrounding said tubular metal body portion between said opposite ends thereof, sealing means between said lens means and housing means, and means removably mounting said lens means on said housing means.

2. A nautical light according to claim 1, wherein said wall means includes end wall means at the other of said opposite ends of said tubular body portion, said cylindrical lens means including an end wall overlying said end wall means, and said means mounting said lens means on said housing means including threaded fastener means interengaging said end wall of said lens means and said housing means.

3. A nautical light according to claim 1, wherein said body portion includes a sleeve member having axially opposite ends, said wall means including a collar member having axially opposite sides and an annular recess extending axially into one of said opposite sides and receiving one of said ends of said sleeve member.

4. A nautical light according to claim 3, wherein said collar member has an axially extending opening therethrough, and said means supporting said lamp bulb means in said light chamber means includes lamp bulb socket means mounted in said opening.

5. A nautical light according to claim 3, wherein said recess in said collar member includes an annular portion radially outwardly of said one end of said sleeve member, said cylindrical lens means having an end edge facing said portion of said recess, and said sealing means including resilient sealing ring means in said portion of said recess and engaged by said end edge of said lens means.

6. A nautical light according to claim 5, wherein said wall means of said housing means includes end wall means at the other of said opposite ends of said sleeve member, said cylindrical lens means including an end wall overlying said end wall means, and said means mounting said lens means on said housing means including threaded fastener means interengaging said end wall of said lens means and said housing means.

7. A nautical light according to claim 3, wherein said mounting means for said housing includes mounting socket means on the other of said opposite sides of said collar member.

8. A nautical light according to claim 7, wherein said wall means of said housing means includes end wall means at the other of said opposite ends of said sleeve member, said cylindrical lens means including an end wall overlying said end wall means, and said means mounting said lens means on said housing means including threaded fastener means interengaging said end wall of said lens means and said housing means.

9. A nautical light according to claim 8, wherein said recess in said collar member includes an annular portion radially outwardly of said one end of said sleeve member, said cylindrical lens means having an end edge facing said portion of said recess, and said sealing means includes resilient sealing ring means in said portion of said recess and engaged by said end edge of said lens means.

10. A nautical light according to claim 9, wherein said collar member has an axially extending opening therethrough, and said means supporting said lamp bulb means in said light chamber means includes lamp bulb socket means mounted in said opening.

11. A nautical light according to claim 1, wherein said transversely extending wall means includes first, second and third wall means, said light chamber means includes a first light chamber between said first and second wall means and a second light chamber between said second and third wall means, and said window means includes first and second windows opening respectively into said first and second light chambers.

12. A nautical light according to claim 11, wherein said first and second windows have radial axes circumferentially offset with respect to said axis of said body portion.

13. A nautical light according to claim 12, wherein the circumferentially spaced apart side edges of said first window are in axial alignment with the circumferentially spaced apart side edges of said second window.

14. A nautical light according to claim 11, wherein said body portion includes a sleeve member having opposite ends, said first wall means including a collar member having axially opposite sides and an annular recess extending axially into one of said opposite sides and receiving one of said ends of said sleeve member, said second wall means being an intermediate wall member mounted in said sleeve member between said opposite ends thereof, and said third wall means being an end wall member at the other of said opposite ends of said sleeve member.

15. A nautical light according to claim 14, wherein said collar member and said intermediate wall member each include an axially extending opening therethrough, and said means supporting said lamp bulb means in said light chamber means includes lamp bulb socket means mounted in said openings for supporting a lamp bulb in said first and second light chambers respectively.

16. A nautical light according to claim 15, wherein said lens means includes an end wall overlying said end wall member, and said means mounting said lens means on said housing means includes threaded fastener means interengaging said end wall of said lens means and said housing means.

17. A nautical light according to claim 16, wherein said recess in said collar member includes an annular portion radially outwardly of said one end of said sleeve member, said cylindrical lens means having an end edge facing said portion of said recess, and said sealing means includes resilient sealing ring means in said portion of said recess and engaged by said end edge of said lens means.

18. A nautical light according to claim 17, wherein said mounting means for said housing includes mounting socket means on the other of said opposite sides of said collar member.

19. A nautical light according to claim 18, wherein said first and second windows have radial axes circumferentially offset with respect to said axis of said body portion.

20. A nautical light according to claim 19, wherein the circumferentially spaced apart side edges of said first window are in axial alignment with the circumferentially spaced apart side edges of said second window.

21. A nautical light according to claim 1, wherein said lens means includes opaque and transparent portions, said transparent portion corresponding dimensionally with said window means in said body portion of said housing means.

* * * * *